United States Patent [19]

Lin

[11] Patent Number: 4,791,335

[45] Date of Patent: Dec. 13, 1988

[54] DECORATIVE BULB WITH ANNULAR GROOVE AND WATER-PROOF SOCKET

[76] Inventor: Mei-Mei Lin, 2nd Fl., No. 10, Alley 10, Lane 53, Tung-Nan St., Hsin-Chu, Taiwan

[21] Appl. No.: 148,863

[22] Filed: Jan. 27, 1988

[51] Int. Cl.[4] ..... H01J 5/60; H01J 5/62; H01K 1/42; H01R 33/00

[52] U.S. Cl. ..... 313/318; 439/426

[58] Field of Search ..... 313/318, 324; 439/425, 439/426, 611, 613, 616, 619

[56] References Cited

U.S. PATENT DOCUMENTS

| | | | |
|---|---|---|---|
| 2,692,374 | 10/1954 | Carson | 439/425 |
| 4,125,622 | 5/1979 | Fitzgerald | 313/318 |
| 4,630,877 | 12/1986 | Moore | 439/611 X |

*Primary Examiner*—David K. Moore

*Assistant Examiner*—K. Wieder

[57] ABSTRACT

A decorative bulb includes:

a bulb socket, a pair of doubly-sticking conducting plates inserted in the socket to electrically connect a pair of filament leads with two electric wires, a sealing plug sealing the socket bottom and squeezing the two wires with the two conducting plates for ensuring a better electric contact between the wires and the conducting plates, and a bulb having an annular groove formed on a bulb periphery engaged with a ring extension formed inside the socket, so as to obtain a decorative bulb with stabler mounting of the grooved bulb within the ring-extended socket for water-proof purpose and to save production cost by eliminating a base as conventionally embedded between the bulb and the socket.

5 Claims, 3 Drawing Sheets

DECORATIVE BULB WITH ANNULAR GROOVE AND WATER-PROOF SOCKET

BACKGROUND OF THE INVENTION

A conventional decorative bulb as shown in FIG. 1 comprises: a bulb L inserted in a base B which is then jacketed into a socket S, in which two leads L1 of the bulb filament are respectively connected to two power wires W by a pair of conducting plates C. However, it still reveals following drawbacks or matters to be improved:

1. The bulb L must be first inserted in a base B and then mounted into the socket S to increase production cost.

2. A conducting plate C is formed a single needle portion C1 for sticking a conducting wire W, thereby possibly influencing its electric conductance.

3. A plug P is provided on the socket bottom, but without forming well engagement between the socket and the plug, so that its water proof effect is quite limited.

4. The cylindrical surface of bulb L is smoothly jacketed into the base to thereby be easily withdrawn.

The present inventor has found these phenomena and invented the present bulb with annular groove and water-proof socket.

SUMMARY OF THE INVENTION

The object of the present invention is to provide a decorative bulb including: a bulb socket, a pair of doubly-sticking conducting plates inserted in the socket to electrically connect a pair of filament leads with two electric wires, a sealing plug sealing the socket bottom and squeezing the two wires with the two conducting plates for ensuring a better electric contact between the wires and the conducting plates, and a bulb having an annular groove formed on a bulb periphery engaged with a ring extension formed inside the socket, so as to obtain a decorative bulb with stabler mounting of the grooved bulb within the ring-extended socket and to save production cost by eliminating a base as conventionally embedded between the bulb and the socket.

DETAILED DESCRIPTION

Figure 1:
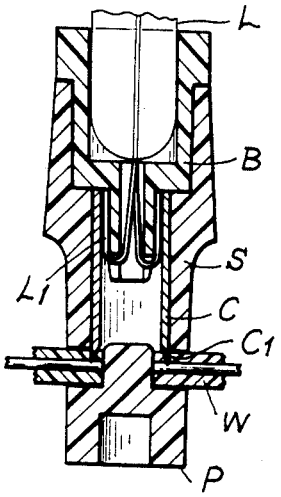
FIG.1 PRIOR ART
FIG. 1 shows a prior art of a conventional decorative bulb.

As shown in FIGS. 2–6, the present invention comprises: a bulb socket 1, a pair of doubly-sticking conducting plates 2, a pair of electric wires 3 electrically connected to a power source, a sealing plug 4 and a grooved bulb 5.

The bulb socket 1 includes: an upper cylindrical hole 11 formed on an upper portion of the socket 1 and a lower rectangular hole 13 formed on a lower portion of the socket 1 having two recess grooves 131 formed on two parallel sides on a middle portion of the hole 13.

An upper opening edge 111 is taperedly formed on the top edge of the hole 11 which is thermally expanded and then cooled to shrinkingly fasten the bulb 5 as inserted in the hole 11 of socket 1. A ring extension 12 is formed inside the hole 11 proximate to the upper opening edge 111. A lowest end of hole 11 forms a horizontal seat 112 intersecting an upper end of the rectangular hole 13.

Each doubly-sticking conducting plate 2 is directly stamped or pressed from an one-piece metallic plate electrically conductive such as copper plate and includes: an upper arcuate plate 21 concave outwardly and retained under the ring extension 12 and on the horizontal seat 112 of the socket 1, a lower slim plate 22 protruding downwardly from the upper plate having an angle portion recessed inwardly 221, a longitudinal needle portion 23 having arcuate cross section protruding downwardly from the lower plate 22 and a transverse needle portion 24 protruding horizontally and inwardly from the lower plate 22.

Figure 2:
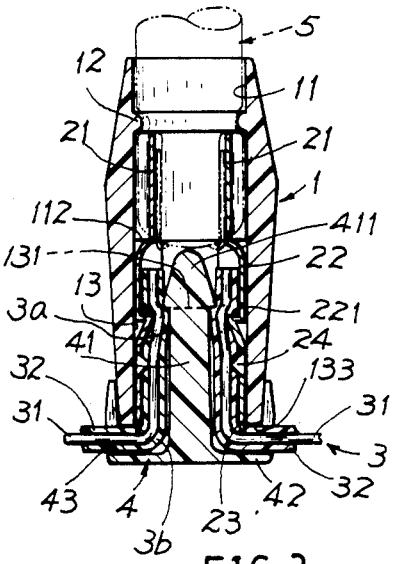
FIG. 2 is a sectional illustration showing the present invention as assembled.
Figure 3:
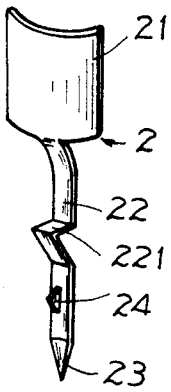
FIG. 3 is a perspective view of a conducting plate of the present invention.
Figure 4:
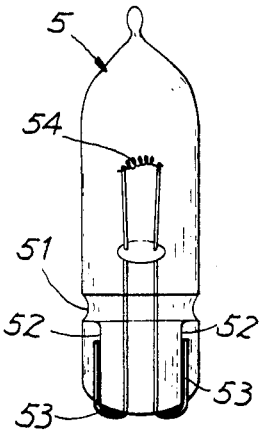
FIG. 4 is a front view of the bulb of the present invention.
Figure 5:
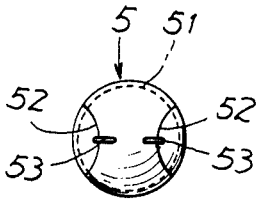
FIG. 5 is a bottom view of the bulb of the present invention.
Figure 6:
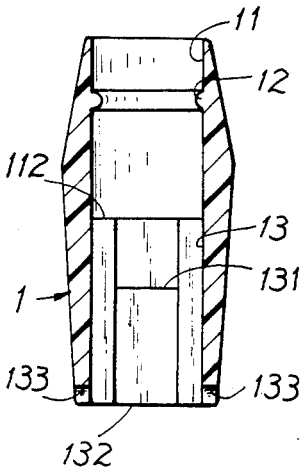
FIG. 6 is a front-view sectional drawing of the socket of the present invention.
Figure 7:
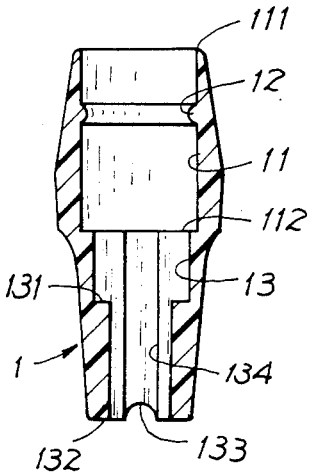
FIG. 7 is a side-view sectional drawing of the bulb.
Figure 8:
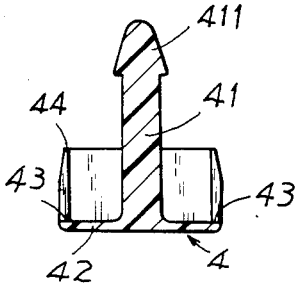
FIG. 8 is a front view of the plug of the present invention.
Figure 9:
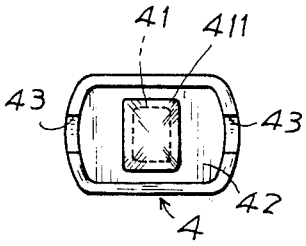
FIG. 9 is a top-view illustration of FIG. 8.
Figure 10:
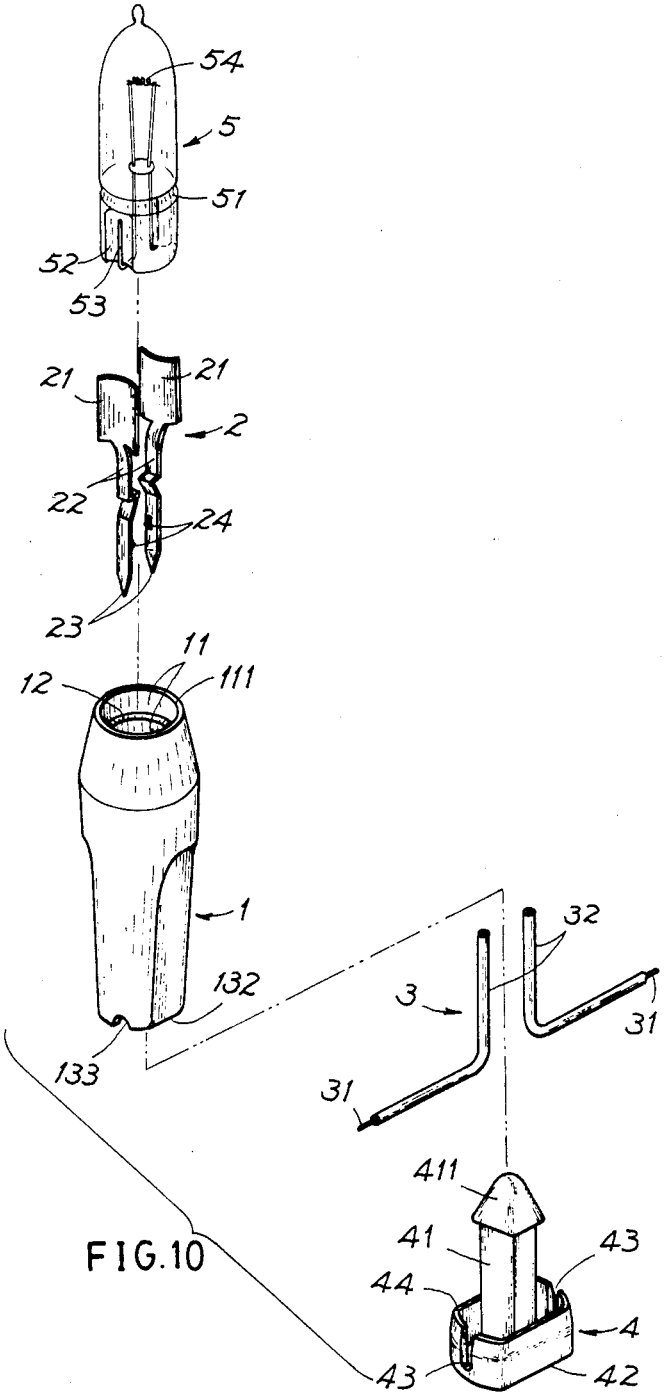
FIG. 10 is an exploded view of the present invention.

Each electric wire 3 includes a central conductance wire 31 sheathed in an insulator cable 32. The wire 3 forms an elbow having a vertical portion 3*a* poking into the lower hole of socket 1 and a right-angle portion 3*b* bent on a lower edge 132 of socket 1 as shown in FIG. 2.

The sealing plug 4 for sealing a bottom portion of the socket includes a central partition stem 41 having a hook head 411 formed on a top portion of the plug 4 separating the two vertical portions 3*a* of the two wires 3, a bottom cap 42 having rectangular side walls 44 tapered upwardly for sealing the socket, engaged with the lower opening edge 132 of socket 1 and two recesses 43 formed on two opposite side walls of the cap 42 to pass the two wires 3 also passing through two recesses 133 formed on two lower opposite sides of the socket 1. The cap 42 can be sealed to the lower edge 132 of socket 1 by engaging the hook head 411 with the recess grooves 131 of socket 1 and with the angle portions 221 of the two conducting plates 2 and can be further sealed by adhesive bonding for water-proof purpose. A pair of longitudinal grooves 134 are longitudinally formed inside said socket 1 for fixing the two conducting plates 2 in two grooves 134.

The grooved bulb 5 is formed an annular groove 51 along a lower periphery of the bulb, two lower recess portions 52 formed on a lower portion of bulb 5 and two leads 53 for connecting a filament 54 inside the bulb having two lower lead portions bent upwardly to dispose on the two lower reces portions 52 of bulb 5 to contact the upper arcuate plate 21 of conducting plate 2 within the upper hole 11 of socket 1.

When assembling a bulb of the present invention, two conducting plates 2 are pre-inserted in the socket 1 and two wires 3 with the two elbows 3*a*, 3*b* poling into lower hole 13 are processed by contacting each vertical portion 3*a* with each lower plate 22 and the plug 4 is inserted into the lower hole 13 to allow the partition stem 41 to squeeze each wire 3 to be stuck by the two needle portions 23, 24 of the conducting plate 2 against an inside wall of the lower hole 13 of socket 1 so as to firmly secure the wires 3 in the socket 1 and to ensure the better electrical connection between each wire 3 and each conducting plate 2 by sticking the needle portion 23, 24 through the insulator cable 32 to electrically contact the central conductance wire 31. The bulb 5 is inserted into upper hole 11 by engaging its annular groove 51 with the ring extension 12 inside the socket 1 to outwardly press each upper arcuate plate 21 against an inside wall of the upper hole 11 so as to better connect each plate 2 with each wire 3 electrically.

The socket 1 and plug 4 can be made of insulating materials, such as plastic materials.

For the above-mentioned structure and assembly, the present invention can have the following advantages superior to a conventional bulb:

1. A traditional bulb base is omitted in this invention to save production cost.

2. The doubly-sticking conducting plate 2 provides a better electrical conducting between a power source and the bulb, and also to ensure a firm fixation of the conducting plates 2 in the socket 1 for preventing their loosening or separating damage.

3. The bulb 5 is grooved for its sound engagement within a socket extension for preventing a bulb withdrawal from a socket.

4. The upper edge 111 of socket 1 is thermally treated to better secure the bulb 1 therein and the lower edge 132 is well sealed by the plug 4 to enhance water proof effect for this bulb.

I claim:

1. A decorative bulb means comprising:

a bulb socket having an upper cylindrical hole formed on an upper portion of the socket and a lower rectangular hole formed on a lower portion of the socket, said upper hole having a ring extension formed therein proximate to an upper opening edge of said socket, a lower seat formed on a lowest end of said upper hole;

a pair of doubly-sticking conducting plates respectively inserted in said socket, each conducting plate having an upper arcuate plate concave outwardly and retained between said ring extension and said lower seat in said upper hole, a lower slim plate protruding downwardly from said upper arcuate plate having an angle portion recessed inwardly operatively retaining an electric wire in said socket, a longitudinal needle portion protruding downwardly from said lower slim plate, and a transverse needle portion protruding horizontally inwardly from said lower plate;

a pair of electric wires for power source each forming an elbow having a vertical portion poking into said lower hole and a right-angle portion bent on a lower opening edge of said socket, said vertical portion being stuck by said transverse needle portion of said conducting plate and said right-angle portion stuck by said longitudinal needle poriton of said conducting plate;

a sealing plug sealing a bottom portion of said socket and having a central partition stem inserted into said lower hole to separate the two electric wires and squeeze the two wires against an inside wall of said lower hole for better securing and electrically conducting of said wires in said socket; and a grooved bulb having an annular groove formed on a lower periphery of said bulb operatively engaged with said ring extension of said socket, having two leads of bulb filament protruding outside said bulb and bent upwardly to dispose on two lower recess portions on a lower portion of said bulb to operatively contact said conducting plates in said upper hole of said socket.

2. A bulb means according to claim 1, wherein said doubly-sticking conducting plate is directly stamped, pressed from an one-piece metallic plate electrically conductive.

3. A bulb means according to claim 1, wherein said sealing plug includes a cap engaged with a lower opening edge of said socket, having two recesses formed on two opposite sides on said cap for passing the two electric wires poking into the lower hole of said socket, said cap having rectangular side walls tapered upwardly for sealing said socket and having a hook head formed on a top portion of said central partition stem operatively engaged with two angle portions respectively formed on two said lower slim plates of two said conducting plates and engaged with two recess grooves parallelly formed on a middle portion of said lower hole of said socket.

4. A bulb means according to claim 1, wherein said socket having an upper opening edge tapered upwardly adapted for being thermally treated to seal a lower portion of said bulb for water-proof purpose.

5. A bulb means according to claim 1, wherein said socket has a pair of longitudinal grooves longitudinally formed inside said socket for engageably fixed said two conducting plates in said longitudinal grooves.

* * * * *